US008510913B2

(12) United States Patent
Kim

(10) Patent No.: US 8,510,913 B2
(45) Date of Patent: Aug. 20, 2013

(54) DOOR HINGE FOR A REFRIGERATOR

(75) Inventor: Doo Ha Kim, Siheung-si (KR)

(73) Assignee: Daeyeong E&B Co. Ltd., Ansani-Si. Gyeonggi-Do (KR)

( * ) Notice: Subject to any disclaimer, the term of this patent is extended or adjusted under 35 U.S.C. 154(b) by 0 days.

(21) Appl. No.: 13/418,742

(22) Filed: Mar. 13, 2012

(65) Prior Publication Data

US 2013/0067688 A1 Mar. 21, 2013

(30) Foreign Application Priority Data

Sep. 16, 2011 (KR) ..... 10-2011-0093297

(51) Int. Cl.
*E05D 11/10* (2006.01)
*E05F 1/02* (2006.01)

(52) U.S. Cl.
USPC ..... 16/334; 16/312; 16/315; 16/317; 16/268; 16/344

(58) Field of Classification Search
USPC ..... 16/244, 243, 248, 309, 312, 374, 16/375, 303, 330, 338, 340, 327–329, 314, 16/315; 312/326, 309, 405, 295, 227; 49/381, 49/388, 397
See application file for complete search history.

(56) References Cited

U.S. PATENT DOCUMENTS

| | | | | | |
|---|---|---|---|---|---|
| 3,722,031 | A | * | 3/1973 | Bourgeois | 16/317 |
| 4,070,728 | A | * | 1/1978 | Herman | 16/243 |
| 4,090,274 | A | * | 5/1978 | Bourgeois | 16/317 |
| 4,774,740 | A | * | 10/1988 | Gidseg et al. | 16/344 |
| 4,864,691 | A | * | 9/1989 | Gidseg et al. | 16/312 |
| 5,369,842 | A | * | 12/1994 | Beatty | 16/317 |
| 6,374,458 | B1 | * | 4/2002 | Finkelstein | 16/235 |

FOREIGN PATENT DOCUMENTS

| | | | | |
|---|---|---|---|---|
| DE | 202004007524 | U1 | * | 9/2005 |
| JP | 11257836 | A | * | 9/1999 |
| KR | 2001026264 | A | * | 4/2001 |
| KR | 10-0581362 | B1 | | 5/2006 |

* cited by examiner

*Primary Examiner* — Chuck Y. Mah
(74) *Attorney, Agent, or Firm* — Sherr & Jiang, PLLC

(57) ABSTRACT

A door hinge unit in a refrigerator which pivots a door on a refrigerator body, and holds the door to maintain an opened state or a maximum opened state at a predetermined position for preventing the door from hitting an external object and a hinge shaft from breaking, and minimizes a friction surface between a male member and a female member of the hinge for making movement of the hinge smooth and preventing the hinge from causing noise.

4 Claims, 6 Drawing Sheets

DOOR HINGE FOR A REFRIGERATOR

CROSS REFERENCE TO RELATED APPLICATION

This application claims the benefit of the Patent Korean Application No. 10-2011-0093297, filed on Sep. 16, 2011, which is thereby incorporated by reference as if fully set forth herein.

BACKGROUND OF THE DISCLOSURE

1. Field of the Disclosure

The present invention relates to a door hinge unit in a refrigerator, and more particularly to a door hinge unit in a refrigerator which pivots a door on a refrigerator body, and holds the door to maintain an opened state or a maximum opened state at a predetermined position for preventing the door from hitting an external object and a hinge shaft from breaking, and minimizes a friction surface between a male member and a female member of the hinge for making movement of the hinge smooth and preventing the hinge from causing noise.

2. Discussion of the Related Art

In general, the door, particularly, an opening and closing door in the refrigerator is provided with hinges having female members respectively fastened to brackets at upper and lower portions of an open portion of the body, and male members fixed to the door for respectively pivoting the female members.

Since the door hinged with the hinge unit has no holding means for holding the opened position of the door which can be opened from complete closure to full open and further opening from the full open, the door has problems in that the door hits an external object as the door is opened without limit to cause damage to the door due to the impact, and unavailability of door holding for taking out goods or putting the goods into the refrigerator after leaving the door opened at a certain position results in inconvenience of the user.

As a prior art for solving the problems, the Korean patent No. 10-0581362 discloses a hinge unit reciting characteristics of some of elements thereof in an element parameter style.

That is, the door hinge shaft in a refrigerator is provided with a female member having recesses fastened to a bracket which is fastened to a lower side of the refrigerator, and a male member having a hinge shaft projected therefrom fastened to a lower end of the door with the hinge shaft hinged on a shaft hole of the female member and placed in the recess, wherein the recesses and the projections form a refrigerator rotation shaft device having a female member plate with at least two upward ridges which are two projections spaced by grooves which are the recesses to have equal pitches formed thereon to have a cylindrical shape on the whole, and a male member plate formed in conformity with the upward ridges on the female member plate to have downward grooves which are the recesses with grooves in an underside to engage with the upward ridges such that the male member is mounted to a lower side of the door to move in a circumferential direction and vertical direction in engagement with the upward ridges at the time of opening and closing, wherein the upward ridges and the downward grooves respectively have radial angles 30°, 40° and 10° from a center of an inside diameter on a flat surface, and a gentle sloped portion, a horizontal portion, and a steep sloped portion in succession starting from a door open direction with reference to a radial imaginary line so that the gentle sloped portion, the horizontal portion, and the steep sloped portion adapt or resist to the circumferential and vertical movement.

As described before, since the prior art has a projection with the gentle sloped portion, the horizontal portion, and the steep sloped portion, and the male member has identical projections in conformity with the projections, to have a large horizontal portion area to form a large friction surface at the time of rotation of the female member and the male member due to the large horizontal portion, the prior art has problems in that control of movement of the door is difficult, noise is caused by the friction, and the ridges and grooves become smaller unable to control exact stop position of the door.

And, the prior art has problems in that the three ridges allow the door of the refrigerator to move further beyond a maximum open angle unable to prevent the door from making an impact to a surrounding wall or other object.

SUMMARY OF THE DISCLOSURE

Accordingly, the present invention is directed to a door hinge unit.

An object of the present invention is to provide a door hinge unit which can improve the problems of the prior art described before in which the upward ridges and the downward grooves have radial angles from a center of an inside diameter on a flat surface, the gentle sloped portion, the horizontal portion, and the steep sloped portion formed in succession in an open direction to a close direction of the door cause friction and noise, the three ridges and grooves allow the door to open beyond 180 degrees to make impact to an external wall or foreign object, so that the door hinge unit in a refrigerator of the present invention has a simple configuration, minimum noise, and minimum wear caused by the friction, and the door is not to open beyond 180 degrees.

Another object of the present invention is to provide a door hinge unit which has peak portions for making friction with a horizontal surface to minimize a friction area for minimizing friction noise from the friction and enhancing smooth movement, and is easy to identify a side of attachment of a female member and a male member for fast and exact assembly.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed put in the written description and claims hereof as well as the appended drawings.

To achieve these objects and other advantages and in accordance with the purpose of the invention, as embodied and broadly described herein, a door hinge unit in a refrigerator includes a female member 10 fastened to a bracket 101 which is, in turn, fastened to an opened portion of the refrigerator 100, and a male member 20 fastened to an opening and closing door 110 for setting a position of the door in opening and closing the door step by step as a groove 30 in the female member 10 engages with a ridge on the male member 40, wherein the female member 10 and the male member 20 respectively include circular female and male member plates 11 and 21 each having an outside diameter with a radius of 15.5 mm from a shaft hole 12 in the female member 11, or from a hinge shaft 22 of the male member 20, wherein the female and male member plates 11 and 21 respectively include grooves 30 and ridges 40 each having a peak portion 31 or 41 with a maximum depth or height on a horizontal line from the hinge shaft 22 at a 3.8 mm depth or height from a flat surface of the female member plate 11 or the male member plate 21, to have front/rear direction grooves 30 on a straight line in the female member plate 11 formed from a 0 degree close angle to a 105 degrees in an opening direction on the horizontal line, a long sloped surface 32 or 42 connected from the peak portion 31 or 41 to the female member plate 11 or the male member plate 21 at 23.01 degrees with reference to the hinge shaft 22 in a door 110 open direction, a gentle sloped surface 33 or 43 positioned at 3 mm depth or height from the female member plate 11 or the male member plate 21 connected from the peak portion 31 or 41 to the female member plate 11 or the male member plate 21 at 12.26 degrees with reference to the hinge shaft 22 in a door 110 close direction, and a steep sloped surface 34 or 44 connected from an end of the gentle sloped surface 33 or 43 to the female member plate 11 or the male member plate 21 at 7.01 degrees with reference to the hinge shaft 22 of the female member plate 11 or the male member plate 21, wherein the grooves 30 and the ridges 40 are positioned within a space between the outside diameter with the radius 15.5 mm to an inside diameter of 3.8 mm.

The ridges 40 and the grooves 30 of the female member 10 and the male member 20 which form a door 110 open angle are formed from a door 110 close angle 0 degree to a door 110 open angle 105 degrees and a maximum door open angle 180 degrees to set a position of the door in opening and closing the door 110 step by step.

The female member 10 and the male member 20 are fastened to the bracket 101 or the door 110 with a twist angle of 3~5 degrees, respectively.

The female member 10 and the male member 20 are formed to have a shape which identifies a side of attachment of the female member 10 or the male member 20, wherein a member to be attached to a left side has a shape that implies an "L", and a member to be attached to a right side has a shape that implies an "R".

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment (s) of the disclosure and together with the description serve to explain the principle of the disclosure. In the drawings.

DESCRIPTION OF SPECIFIC EMBODIMENTS

Figure 1A:
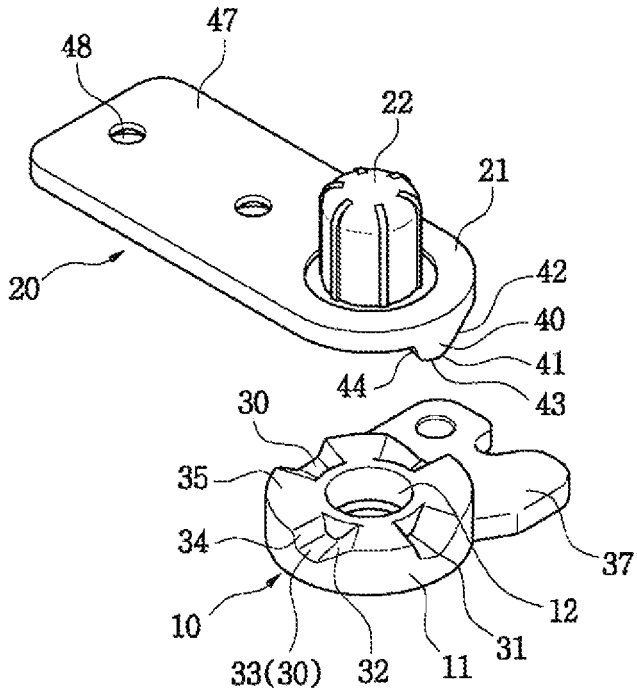
FIG. 1A illustrates a perspective view of a female member and a male member in accordance with a preferred embodiment of the present invention.
Figure 1B:
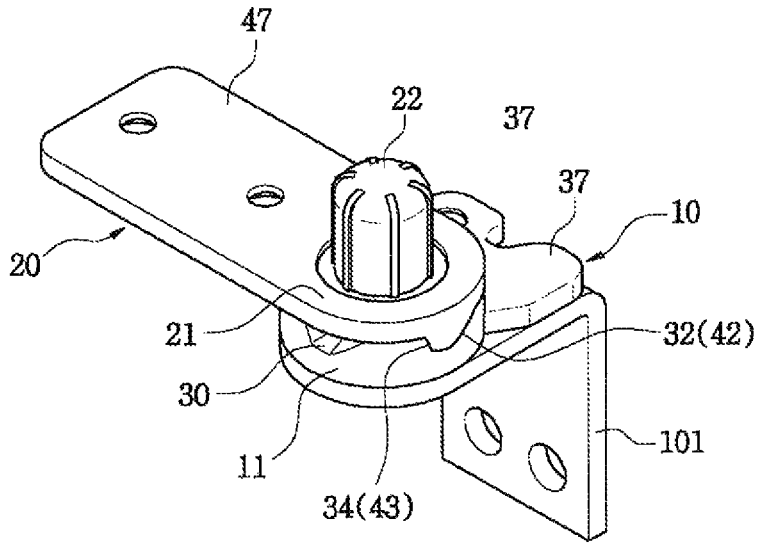
FIG. 1B illustrates a perspective view showing the female member and the male member in FIG. 1A coupled together.

Reference will now be made in detail to the specific embodiments of the present invention, examples Of which are illustrated in the accompanying drawings. Wherever possible, the same reference numbers will be used throughput the drawings to refer to the same or like parts.

A door hinge unit in a refrigerator in accordance with a preferred embodiment of the present invention includes a female member 10 fastened to a bracket 101 which is, in turn, fastened to an opened portion of the refrigerator 100 in an up/down direction, and a male member 20 pivoted on the female member 10 fastened to an underside of an opening and closing door 110 to support the door 110, for rotating the door 110 pivoted on the female member 10, wherein the female member 10 and the male member 20 respectively have grooves 30 and ridges 40 formed thereon for setting a position of the door in opening and closing the door 110 step by step.

Figure 2:
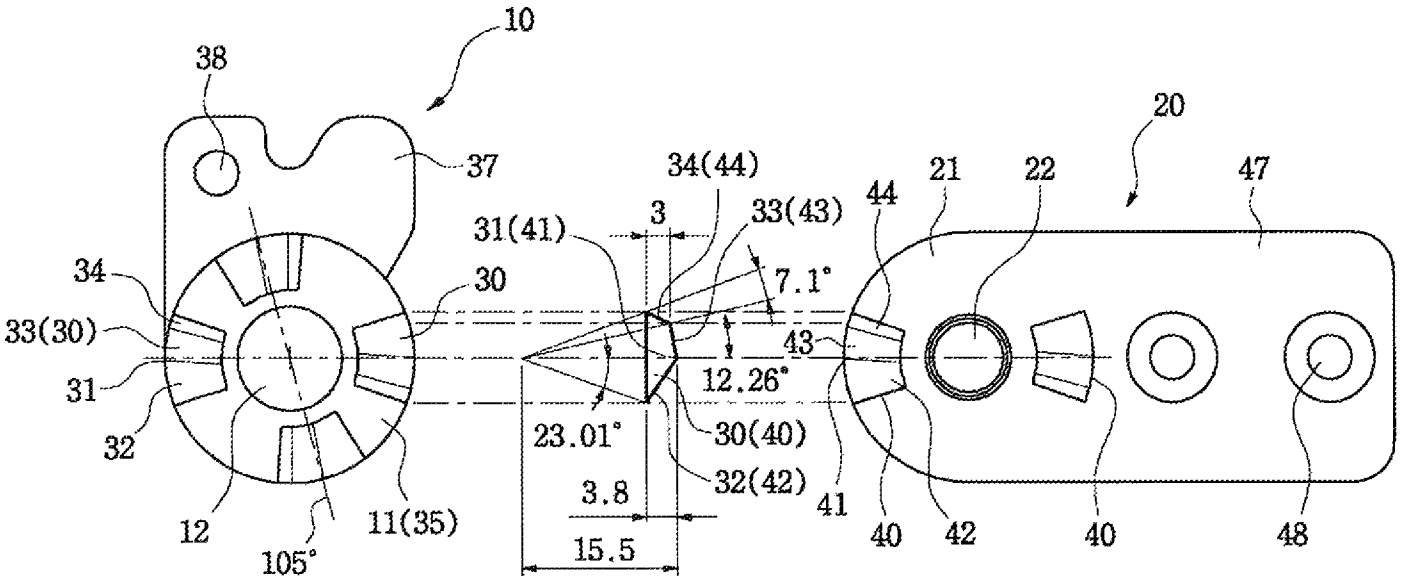
FIG. 2 illustrates a plan view showing ridges in the female member in FIG. 1A and grooves in the male member in FIG. 1A in accordance with a preferred embodiment of the present invention.
Figure 3:
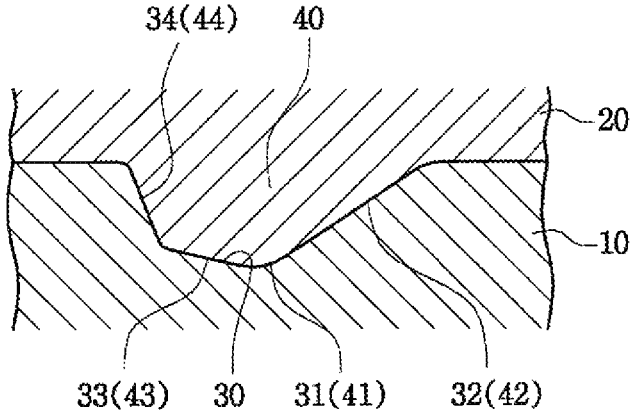
FIG. 3 illustrates a section showing engagement of the ridges and the grooves in FIG. 2 in accordance with a preferred embodiment of the present invention.
Figure 4:
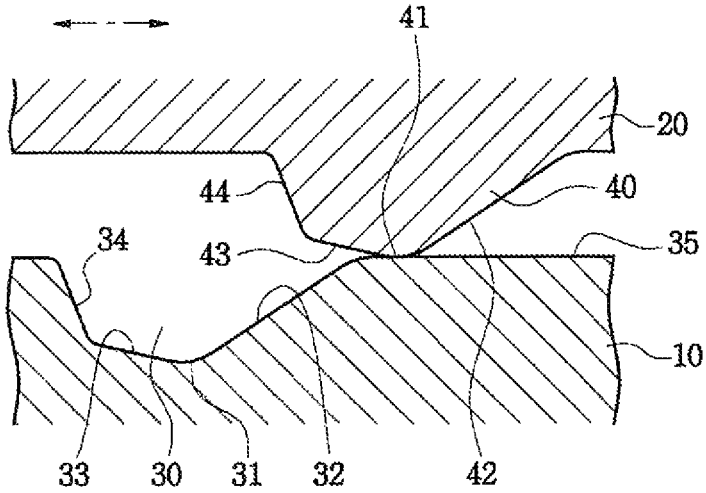
FIG. 4 illustrates a section showing disengagement of the ridges and the grooves in FIG. 2 in accordance with a preferred embodiment of the present invention.

As shown in FIGS. 3 and 4, and represented with reference numerals in FIG. 2, the female member 10 and the male member 20 respectively include circular female and male member plates 11 and 21 each having an outside diameter with a radius of 15.5 mm from a hinge a shaft hole 12 in the female member 11 in a vertical state in which the a door is closed, and from a hinge shaft 22 of the male member 20 set in a length direction to be horizontal to the refrigerator 100 and fastened to the female member plate 11, wherein female and male member plates 11 and 21 include the grooves 30 and ridges 40 each having a peak portion 31 or 41 with a maximum depth or height on a horizontal line starting from the hinge shaft 22 (at 180 degree horizontal line from, the hinge shaft 22) at a 3.8 mm depth or height from a flat surface of the female member plate 11 or the male member plate 21, to have front/rear direction grooves 30 on a straight line in the female member plate 11 at above depth formed from 0 degree closed angle to 105 degrees in an opening direction (of the refrigerator door) on the horizontal line, a long sloped surface 32 or 42 connected from the peak portion 31 or 41 to the female member plate 11 or the male member plate 21 at 23.01 degrees with reference to the hinge shaft 22 in a door 110 open direction, a gentle sloped surface 33 or 43 positioned at 3 mm depth or height from the female member plate 11 or the male member plate 21 connected from the peak portion 31 or 41 to the female member plate 11 or the male member plate 21 at 12.26 degrees with reference to the hinge shaft 22 in a door 110 close direction, and a steep sloped surface 34 or 44 connected from an end of the gentle sloped surface 33 or 43 to the female member plate 11 or the male member plate 21 at 7.01 degrees with reference to the hinge shaft 22 of the female member plate 11 or the male member plate 21.

And, the grooves 30 and the ridges 40 are positioned in a space between the outside diameter with the radius 15.5 mm to an inside diameter of 3.8 mm.

Though the ridge 40 may be smaller than the groove 30 slightly because the ridge 40 is placed in, and engaged with, the groove 30, since a difference thereof required is slight enough to place the ridge 40 in the groove 30, the groove 30 and the ridge 40 are described as if the groove 30 and the ridge 40 have the same sizes.

And, the grooves 30 and ridges 40 of the female member 10 and the male member 20 which set an open angle of the door 110 are formed such that the a position of the door is set step by step at a door 110 open angle of 105 degrees and a, maximum door, open angle 180 degrees (A horizontal line passing the hinge shaft), and a door close groove 30 is formed at a 0 degree on a horizontal (Straight?) line of the maximum open angle which is horizontal to the refrigerator 100.

And, though the female member 10 and the male member 20 are designed and fabricated to make close contact with each other, in order to prevent a problem from taking place, in which, in a case of a multiple door 110 refrigerator, such as two door or three door, opening/closing of one door causes other doors to move due to an internal negative pressure to cause failure of air tightness by breaking away from a gasket or the like and failure of returning to an original position, causing leakage of cold air from an inside of the refrigerator and infiltration of outside air into the refrigerator to cause a side effect in which a temperature difference, or elevation, or drop takes place, the female member 10 is fastened to the bracket 101 or the male member 20 is fastened to the door 110, with an overlap of an angle of 3 to 5 degrees in a twisted state, to prevent the door 110 from opening or to generate a pushing force in a closing direction at the time of closing of the door 110, thereby making the door 110 to press the gasket on an outside circumference of the opened portion of the refrigerator 100 to maintain a tight close force to the gasket.

Though the coupling angles of the groove 30 and the ridge 40 are suggested as an embodiment, different from this, the 0 degree close angle and the 105 degree open angle are not defined as an essential condition, but it is apparent that the angles may be increased of decreased.

The ridges 40 and the grooves 30 engage with each other, to set the door 110 at the engaged position making a position of the door set step by step. Since the peak portion 41 of the ridge 40 slides on a horizontal surface 35 of the female member 10 to form a minimum friction area by the triangular peak portion 41 in the movement of the door 110, the movement is smooth and friction is low, and no noise is generated.

And, the female member 10 or the male member 20 is configured to have a shape which identifies a side of attachment of the female member 10 or the male member 20, i.e., a member to be attached to a left side has a shape that implies an "L", and a member to be attached to a right side has a shape that implies an "R", for a worker to identify a left side or a right side of the member easily enabling the worker to make easy and precise assembly.

Figure 5:
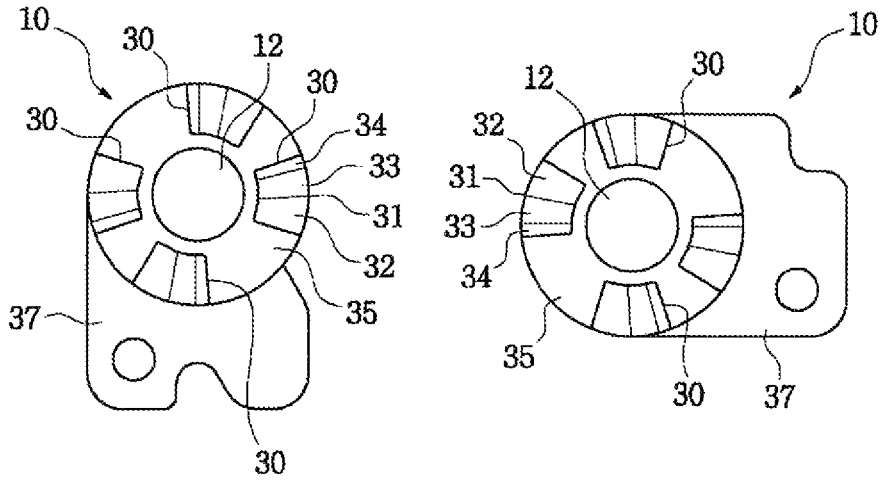
FIG. 5 illustrates a plan view showing a left side hinge member and a right side hinge member in accordance with a preferred embodiment of the present invention.
Figure 6:
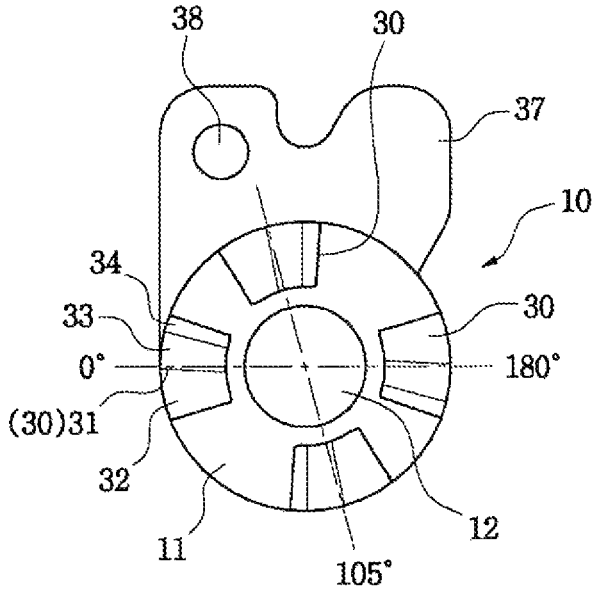
FIG. 6 illustrates a plan view showing an angel of door closure in accordance with a preferred embodiment of the present invention.

Referring to FIG. 5, it is preferable that the shape of "L" or "R" is a whole shape or a shape of a fastening plate 37 or 47 of the member.

Unexplained reference numerals 37 and 47 denote the fastening plate 38 for fastening the female member 10 or the male member 20 to the bracket 101, and 48 denotes a fastening hole.

Operation and effects of the door hinge unit in a refrigerator of the present invention in accordance with a preferred embodiment of the present invention will be described with reference to attached drawings.

Figure 7:
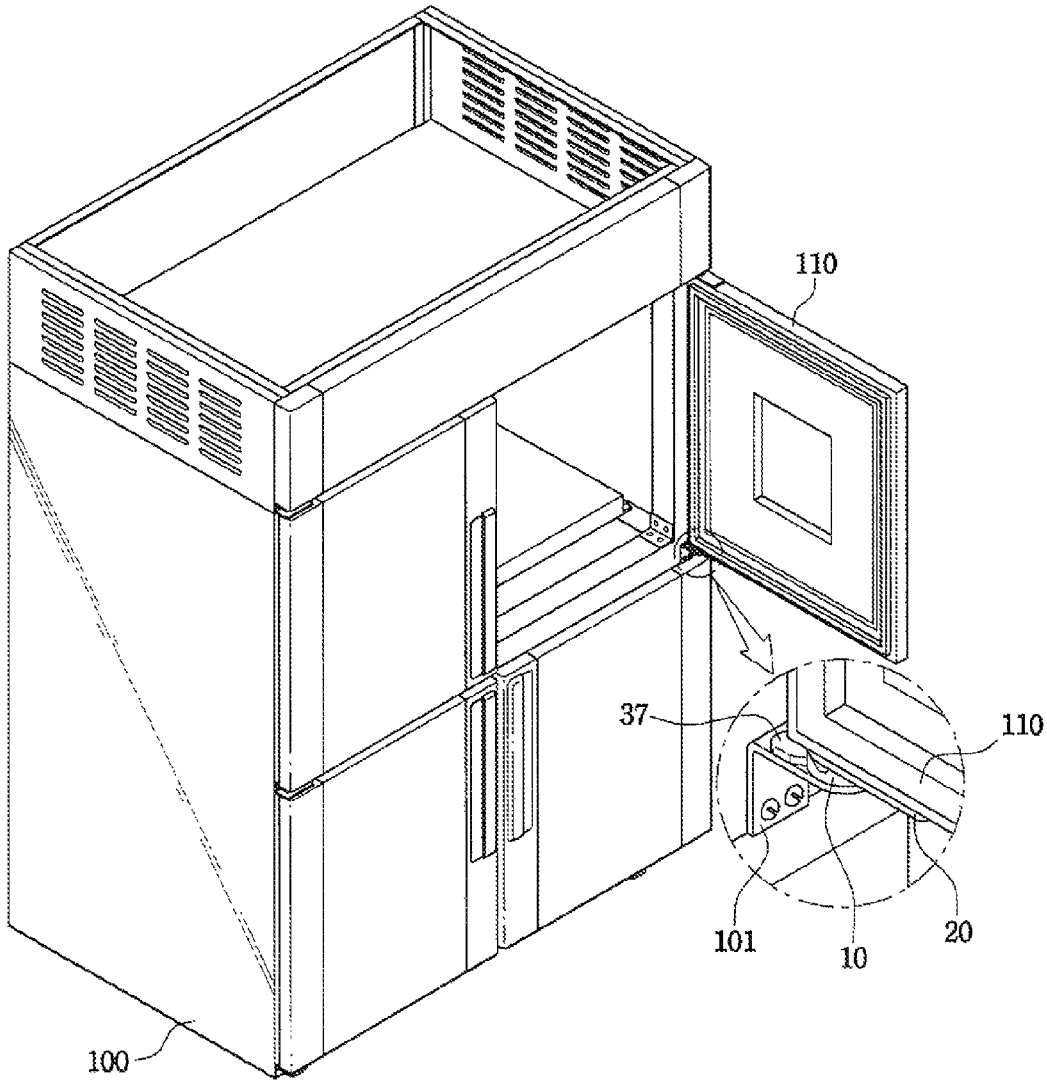
FIG. 7 illustrates a perspective view of a refrigerator in a door opened state having the present invention applied thereto.

Referring to FIG. 7, the door hinge unit enables the door 110 to open and close as the female member 10 is fastened to the bracket 101 which is, in turn, fastened to the opened portion of the refrigerator 100 in an up/down direction and the male member 20 is fastened to the door 110 to pass the hinge shaft 22 of the male member 20 through the shaft hole 12 in the female member 10 pivotally, for the door 110 to rotate pivoted on the female member 10.

The hinge unit of the door 110 is selected such that the door 110 is opened in a left direction or a right direction depending on a user's requirement, i.e., taking user's preference of opening direction into account.

In this instance, worker's confusion on the preference of the opening direction of the door in assembly of the hinge unit causes repetitive assembly or a request for returning the goods from the user.

Therefore, as shown in FIG. 5, the member is shaped in the "L" shape which implies a left side or the "R" shape which implies a right side on one or both of the female member 10 and the male member 20, for the worker to identify the left and the right sides of the member by the shape of the member easily to determine an assembly position of the member easily to reduce inconvenience coming from the confusion and to assemble quickly and exactly.

In order to place goods into or take put from the refrigerator 100 having the door hinge unit of the present invention applied thereto, the user opens the door 110 of the refrigerator 100.

Since the groove 30 is formed to have the maximum depth of 3.8 mm to the peak portion 31 from the flat surface at the outside diameter of the female member plate 11 which has the outside diameter with the radius of 15.5 mm from the shaft hole 12 in the female member plate 11 of the female member 10, and the ridge 40 is formed to have the maximum height of 3.8 mm to the peak portion 41 from the plane at the outside diameter of the male member plate 21 which has the outside diameter with the radius of 15.5 mm from the hinge shaft 22 on the male member plate 21 of the male member 20, the door 110 close state shown in FIG. 3 can suppress easy opening of the door 110 from the door 110 close state naturally or by a slight impact by means of the ridge 40 placed in, and engaged with, the groove 30.

Accordingly, the prevention of the door 110 of the refrigerator 100 from opening easily prevents outside air from entering into the refrigerator 100, and the fastening of the female member 10 to the bracket 101 in a twisted state with an overlap angle of 3 to 5 degrees prevents the door 110 from opening as well as presses the door 110, preventing the door 110 from loosening from the gasket to maintain tight close force to the gasket, thereby preventing the outside air or the cold air from leaking or entering.

And, since the grooves 30 and ridges 40 of the female member 10 and the male member 20 which set an open angle of the door 110 are formed such that the a position of the door is set step by step at a door 110 open angle of 105 degrees and a maximum door open angle 180 degrees, the door 110 is prevented from opening by a slight impact, and since the fastening in the overlap angle at a door 110 close angle of the 0 degree for the door 110 to press the gasket of the refrigerator 100 enables to maintain the tight close force, air tightness can be maintained.

Referring to FIG. 4, when the user pulls the door 110 forward to open the door 110 for putting in or taking out goods, the male member 20 moves together with the movement of the door.

As the male member 20 fastened to the door 110 rotates round the hinge shaft 22 together with the door 110 by the pull, making the peak portion 41 which is a maximum projection portion formed as one unit with the male member 20 to move together with the male member 20 in the groove 30 along the long sloped surfaces 32 and 42 of the groove 30 and the ridge 40 easily making the door 110 and the male member 20 to move upward until the male member 20 moves away from the groove 30 when the male member 20 moves along the horizontal surface of the female member plate 11.

In this instance, since the peak portion 41 of the ridge 40 has a triangular shape to form a minimum friction area with the horizontal surface 35 of the female member 10, the movement of the ridge 40 is made smoother without noise.

As the ridge 40 is placed in the groove 30 at the open angle 105 degrees owing to the movement from the door 110 close state, the door 110 stops at the position, for the door 110 to maintain the door open state by means of the ridge 40 engaged with the groove 30, preventing the door from closing by force or a slight impact.

In this opened state of the door 110, the goods may be placed in or taken out of the refrigerator 100. And, if it is intended to open the door 110 further due to a big size of the goods to be placed in, the door 110 is pushed in a door 110 open direction to rotate the door 110 from above opened state up to 180 degrees to open the door 110, fully.

In this instance too, the ridge 40 of the male member 20 is placed in another groove 30 positioned at 180 degrees preventing the door 110 from closing naturally or by a slight impact, and since the ridge 40 moving thus at the time of the rotation in the opening of the door 110 is placed in the groove 30 preventing the door 110 from moving further, hitting of the door 110, which keeps moving owing to acceleration, to an outside wall or a surrounding decoration is prevented.

At the time of close of the door 110 of the refrigerator 100 opened thus, the door 110 is pushed in a door 110 close direction so that the male member 20 pivoted on the female member 10 together with the door 110 rotates round the hinge shaft 22 making the door 110 and the male member 20 to move, making the ridge 40 projected downward from the male member plate 21 to be pushed from the groove 30 in the female member 10 such that the ridge 40 slides along the gentle sloped surface 33 and 43 formed toward the close direction and the steep sloped surface 34 and 44 connected at 7.01 degrees with reference to the shaft of the female member plate 11 and the male member plate 21, thereby moving the ridge 40 upward to move away from the groove 30 together with the door 110.

And, the peak portion 41 of the ridge 40 slides on a horizontal surface 35 of the female member plate 11 of the female member 10 while moving the door 110 in the close direction until the door 110 reaches to a full close position when the peak portion 41 is placed in and engaged with another groove 30, to close the door 110 such that the door 110 does not move from the closed state preventing the door 110 from opening naturally or forming a gap to improve infiltration of outside air into the refrigerator, and to maintain a tight close state more firmly. And, the pressing by the door 110 onto the gasket owing to the female member 10 fastened with the overlap angle enhances the tight close effect, more.

Thus, the door 110 closed as the ridge 40 of the male member 20 is placed in the groove 30 of the female member 10 does not opened easily, and can be opened only when the user pulls the door 110 with certain force as necessary.

And, since the door 110 closure with the overlap angle fastening makes the door 110 coupled to the groove 30 to position on an inner side from the door close angle 0 to make the door 110 to keep to press the flexible gasket increasing the tight close force of the door to the gasket to maintain air tightness, the cold air leakage from the refrigerator 100 and the infiltration of the outside air into the refrigerator 100 is prevented, perfectly.

Thus, since the door hinge unit in a refrigerator of the present invention includes the female member 10 and the male member 20 respectively including female and male member plates 11 and 21 each having an outside diameter with a radius of 15.5 mm from, the shaft hole 12 in the female member 11, and from the hinge shaft 22 of the male member 20, wherein female and male member plates 11 and 21 respectively include the grooves 30 and ridges 40 each having a peak portion 31 or 41 with a maximum depth or height on a horizontal line starting from the hinge shaft 22 at a 3.8 mm depth or height from a flat surface of the female member plate 11 or the male member plate 21, a long sloped surface 32 or 42 connected from the peak portion 31 or 41 to the female member plate 11 or the male member plate 21 at 23.01 degrees with reference to the hinge shaft 22 in a door 110 open direction, a gentle sloped surface 33 or 43 positioned at 3 mm depth or height from the female member plate 11 or the male member plate 21 connected from the peak portion 31 or 41 to the female member plate 11 or the male member plate 21 at 12.26 degrees with reference to the hinge shaft 22 in a door 110 close direction, and a steep sloped surface 34 or 44 connected from an end of the gentle sloped surface 33 or 43 to the female member plate 11 or the male member plate 21 at 7.01 degrees with reference to the hinge shaft 22 of the female member plate 11 or the male member plate 21, and the grooves 30 and the ridges 40 are positioned in a space between the outside diameter with the radius 15.5 mm to an inside diameter of 3.8 mm, the door hinge unit in a refrigerator of the present invention has a simple structure, and since the ridge 40 and the groove 30 maintain engagement with each other by gravity of the door 110, the door 110 is prevented from opening by slight impact permitting to open the door 110 only when the user pulls the door 110 with a predetermined force enabling to prevent the door 110 from opening easily.

As has been described, the door hinge unit in a refrigerator of the present invention has the following advantages.

The door hinge unit in a refrigerator includes a female member 10 and a male member 20 for providing a hinge to an opening and closing door of the refrigerator having circular female and male member plates 11 and plate 21 with an outside diameter with a radius of 15.5 mm from a hinge shaft 22 of the female and male members 10 and 20, wherein the female and male member plates 11 and plate 21 respectively include grooves 30 in the female member 10 and ridges on the male member 20 each having a peak portion 31 or 41 with a maximum depth or height on a horizontal line from the hinge shaft 22 at a 3.8 mm depth or height from a flat surface of the female member plate 11 or the male member plate 21, a long sloped surface 32 or 42 connected from the peak portion 31 or 41 to the female member plate 11 or the male member plate 21 at 23.01 degrees with reference to the hinge shaft 22, a gentle sloped, surface 33 or 43 positioned at 3 mm depth or height from the female member plate 11 or the male member plate 21 connected from the peak portion 31 or 41 to the female member plate 11 or the male member plate 21 at 12.26 degrees with reference to the hinge shaft 22, and a steep sloped surface 34 or 44 connected from an end of the gentle sloped surface 33 or 43 to the female member plate 11 or the male member plate 21 at 7.01 degrees with reference to the hinge shaft 22 of the female member plate 11 or the male member plate 21, wherein the grooves 30 and the ridges 40 are positioned within a space between the outside diameter with the radius 15.5 mm to an inside diameter of 3.8 mm to make the ridges 40 and the grooves 30 engage with each other to set a position of the door step by step for minimizing a friction area to improve problems caused by the noise and the friction.

And, the female member 10 and the male member 20 are formed to have a shape which identifies a side of attachment of the female member 10 or the male member 20, wherein a member to be attached to a left side has a shape that implies an "L", and a member to be attached to a right side has a shape that implies an "R", for making assembly of the door hinge unit easy.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A door hinge unit for a refrigerator, comprising:

a female member securable to a body of the refrigerator, wherein the female member comprises:

a first fastening plate, and a circular portion connected to one end of the first fastening plate and having a radius of 15.5mm, a shaft hole formed at a central portion thereof, and at least two grooves formed thereon in a radial manner, wherein each of the grooves has a closed inner end spaced apart from the shaft hole with a distance of 3.8mm and an open outer end positioned at an outer circumferential surface of the circular portion; and a male member securable to a door of the refrigerator and pivotably engaged with the female member, wherein the male member comprises:

a second fastening plate, and a male member plate connected to one end of the second fastening plate and rotatably engaged with the circular portion, wherein the male member plate has a hinge shaft passing through the shaft hole and a ridge formed on the male member plate; said ridge being selectively engagable with any one of the grooves in accordance with an angular position of the door which pivots on the hinge shaft, wherein each of the grooves includes:

a valley portion having a depth of 3.8mm from a top surface of the circular portion, an inflection portion spaced apart from the valley portion and having a depth of 3mm from the top surface of the circular portion, a long sloped surface extended from the valley portion to the top surface of the circular portion with an angular distance of 23.01 degrees in a first direction which the door is opened, a gentle sloped surface extended from the valley portion to the inflection portion with an angular distance of 12.26 degrees in a second direction which the door is closed, and a steep sloped surface extended from the inflection portion to the tope surface of the circular portion with an angular distance of 7.1 degrees in the second direction, wherein the valley portion, the inflection portion, the long sloped surface, the gentle sloped surface, and the steep sloped surface are formed between the closed inner end and the open outer end, wherein the ridge is configured to fit in any one of the grooves, wherein said at least two grooves includes:

a first groove positioned at a first position on the circular portion to engage the ridge when the door is closed, and a second groove positioned at a second position on the circular portion and spaced apart from the first position with an angular distance of 105 degrees in the first direction so that the ridge engages with the second groove when the door pivots 105 degrees from a closed position in the first direction.

2. The door hinge unit of claim 1, wherein the grooves further includes a third groove positioned at a third position spaced apart from the first position with an angular distance of 180 degrees in the first direction so that the ridge engages with the third groove when the door pivots 180 degrees from the closed position in the first direction.

3. The door hinge unit of claim 1, wherein the female member having the circular portion and the first fastening plate has a top view having an "R" shape.

4. The door hinge unit of claim 1, wherein the female member having the circular portion and the first fastening plate has a top view having an "L" shape.

* * * * *